US006499982B2

(12) United States Patent
Allen et al.

(10) Patent No.: US 6,499,982 B2
(45) Date of Patent: Dec. 31, 2002

(54) AIR MANAGEMENT SYSTEM FOR THE MANUFACTURE OF NONWOVEN WEBS AND LAMINATES

(75) Inventors: Martin A. Allen, Dawsonville, GA (US); Steve Clark, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/750,820

(22) Filed: Dec. 28, 2000

(65) Prior Publication Data

US 2002/0086072 A1 Jul. 4, 2002

(51) Int. Cl.[7] ..... B29D 7/00
(52) U.S. Cl. ..... 425/83.1; 425/73
(58) Field of Search ..... 425/872, 72.2, 425/73–75, 7, 80.1, 83.1; 55/385.1, 410; 454/49; 198/493

(56) References Cited

U.S. PATENT DOCUMENTS 2,933,152 A * 4/1960 Carpenter et al. ..... 55/319
3,748,693 A * 7/1973 Jespersen ..... 19/156.3
4,432,714 A * 2/1984 Forry et al. ..... 425/93.1
4,526,733 A * 7/1985 Lau ..... 264/12
5,984,990 A * 11/1999 McDonald ..... 55/385.1

* cited by examiner

*Primary Examiner*—Nam Nguyen
*Assistant Examiner*—Brian L Mutschler
(74) *Attorney, Agent, or Firm*—Wood, Herron & Evans, L.L.P.

(57) ABSTRACT

An air handler for collecting air discharged from a melt spinning apparatus. The air handler includes an outer housing having walls defining a first interior space. One of the walls has an intake opening for receiving the discharge air. Another wall has an exhaust opening for discharging the air. The intake opening is in fluid communication with the first interior space. An inner housing is positioned within the first interior space and has walls defining a second interior space. At least one of the walls of the inner housing has an opening. The first interior space communicates with the second interior space through the opening. The second interior space is in fluid communication with the exhaust opening.

23 Claims, 9 Drawing Sheets

AIR MANAGEMENT SYSTEM FOR THE MANUFACTURE OF NONWOVEN WEBS AND LAMINATES

FIELD OF THE INVENTION

The present invention generally relates to apparatus and methods for managing air flow during the manufacture of nonwoven webs and laminates.

BACKGROUND OF THE INVENTION

Meltblowing and spunbond processes are commonly employed to manufacture nonwoven webs and laminates. With meltblowing, a molten thermoplastic is extruded from a die tip to form a row of filaments or fibers. Converging sheets or jets of hot air impinge upon the fibers as they are extruded from the die tip to stretch or draw the fibers, thereby reducing the diameter of the fibers. The fibers are then deposited in a random manner onto a moving collector belt to form a nonwoven web.

With spunbond processes, continuous fibers are extruded through a spinneret. Air is directed at the extruded fibers to separate and orient them. The fibers are collected onto a moving collector belt. At a downstream location, the fibers are consolidated by passing the layer of fibers through compacting roller, for instance. The spunbond process frequently utilizes quenching air to cool the extruded before they contact the collector belt.

Large volumes of air are used during both the meltblown and spunbond process. Moreover, much of the air is heated and moving at very high velocities, sometimes approaching the speed of sound. Without properly collecting and disposing of the process air, the air would likely disturb personnel working around the manufacturing apparatus and other nearby equipment. Further, the heated air would likely heat the surrounding area in which the nonwoven is being produced. Consequently, attention must be paid to collecting and disposing of this process air.

Managing the process air is also important to producing a homogeneous nonwoven web across the width of the web. The homogeniety of the final nonwoven web depends greatly on the air flow around the fibers as they are deposited onto the collector belt. For instance, if the air flow velocity is not uniform in the cross-machine direction, the fibers will not be deposited onto the collector belt uniformly, yielding a non-homogeneous nonwoven web.

Various air management systems have been used to collect and dispose of the process air. One particular air management system uses a collecting duct situated below a perforated collector belt to collect and dispose of the process air. An air moving device, such as a fan or vacuum pump, is connected to the collecting duct to actively draw the air into the collecting duct. The collecting duct is comprised of a plurality of a smaller air passageways arranged side-by-side in a rectangular grid. The grid includes a central row of air passageways extending across the machine width and upstream and downstream air passageways flanking either side of the central row. The central row of air passageways is disposed directly below the extrusion die in what is commonly referred to as the forming zone. Each air passageway includes an inlet and an outlet with a 90 degree elbow in between. An air moving device is operatively connected to each outlet to draw the process air into the individual inlets.

As mentioned above, the air flow velocity of the process air around the collector belt should be uniform, especially in the machine direction at the forming zone, to form a homogeneous nonwoven web. Achieving a uniform air flow velocity, however, has proven challenging. In the collecting duct described above, moveable dampers are associated with each outlet of the air passageways. To achieve uniform air flow velocity with this collecting duct, an technician must manually manipulate each damper until the air flow velocity is sufficiently uniform. In some instances, the technician may be unable to achieve a uniform air flow velocity no matter how much time and effort is spent adjusting the dampers. Moreover, the dampers must be readjusted each time a different fiber material or process air flow rate is used. Thus, the operator must readjust the dampers virtually every time the process is started or an operating condition is changed. The readjustment process takes a great deal of time and may ultimately yield a nonuniform air flow velocity regardless of how the moveable dampers are adjusted.

What is needed, therefore, is an air management system that can collect and dispose of the process air so as to produce a uniform air flow velocity at the collector belt, especially around the forming zone. The air management system should be designed such that dampers and other manual controls are not necessary, even over a wide range of process air flow rates.

SUMMARY OF THE INVENTION

The present invention provides a melt spinning system and, more particularly, a melt spinning and air management system that overcomes the drawbacks and disadvantages of prior air management systems. The air management system of the invention includes at least one air handler for collecting air discharged from a melt spinning apparatus. In accordance with a general objective of the invention, the air handler produces a uniform air flow velocity in at least the cross-machine direction as the air enters the air handler. This is accomplished without the typical adjustable baffles and dampers required in the past. The air handler generally includes an outer housing having walls defining a first interior space. One of the walls has an intake opening for receiving the discharge air from the melt spinning apparatus. Another wall has an exhaust opening for discharging the air collected by the air handler. The intake opening is in fluid communication with the first interior space. An inner housing is positioned within the first interior space and has walls defining a second interior space. At least one of the walls of the inner housing has an opening. The first interior space communicates with the second interior space through the opening. The second interior space is in fluid communication with the exhaust opening.

In one aspect of the invention, the opening between the first interior space and the second interior space is an elongate slot and preferably includes a center portion having a wider dimension than the end portions thereof. The intake opening is positioned at the top of the outer housing, and the slot in the inner housing is disposed proximate to the bottom of the outer housing. The outer housing can further include a filter member for filtering particulates from the air discharged by the melt spinning apparatus.

The invention further provides an air management system including three air handlers. One air handler is positioned directly below the melt spinning apparatus in a forming zone. Another air handler is positioned upstream of the forming zone, and the other air handler is positioned downstream of the forming zone. The widths of the intake opening of the upstream and downstream air handlers in the machine direction are respectively greater than the width of the intake opening of the air handler positioned below the forming zone. The upstream and downstream air handlers collect air which spills over, i.e., not collected, from the air handler below the forming zone.

Various additional advantages and features of the invention will become more readily apparent to those of ordinary skill in the art upon review of the following detailed description taken in conjunction with the accompanying drawings.

DETAILED DESCRIPTION OF DRAWINGS

DETAILED DESCRIPTION OF THE PREFERRED EMBODIMENT

Figure 1:
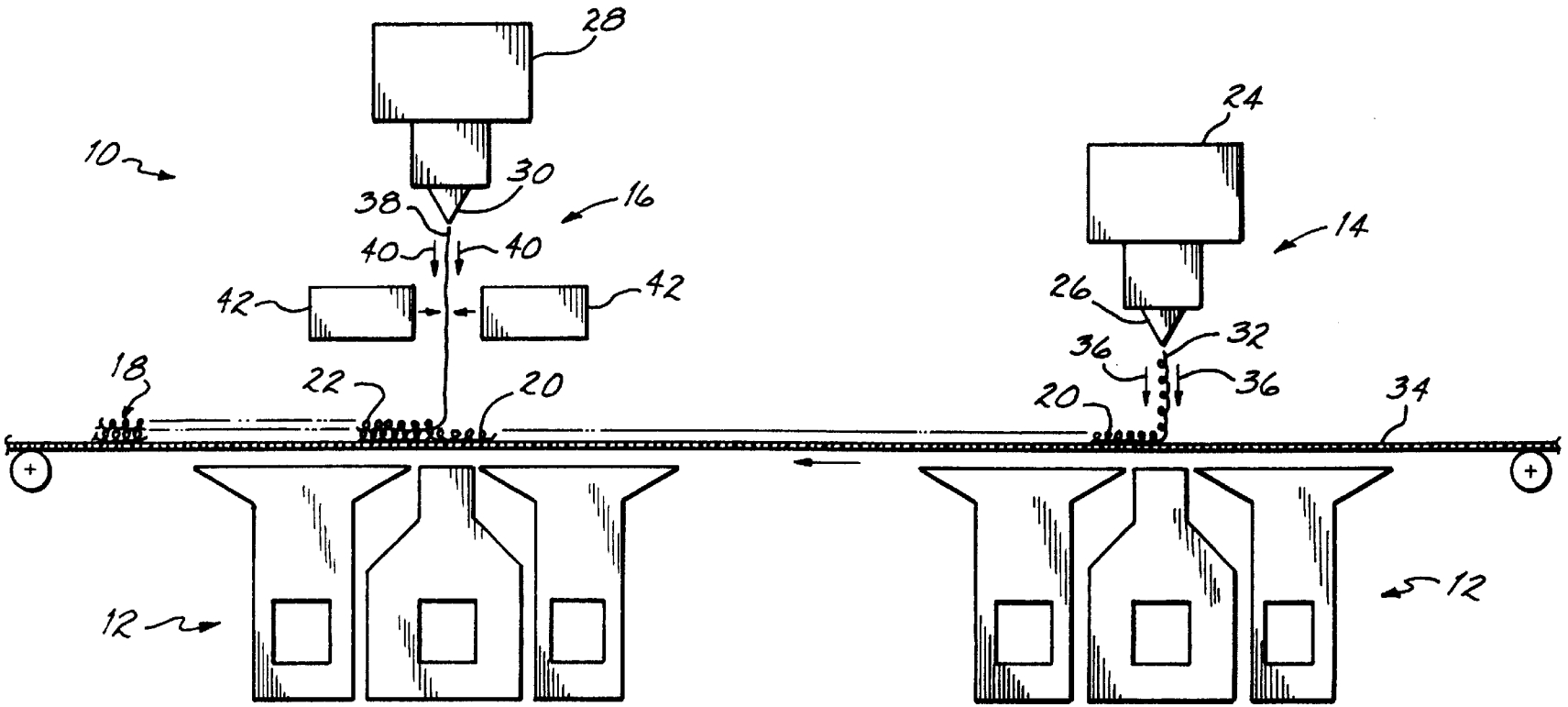
FIG. 1 is a schematic plan view of a two-station production line incorporating the air management system of the invention.

With reference to FIG. 1, a two-station production line 10 is schematically illustrated. The production line 10 incorporates an air management system 12 of the invention at both an upstream station 14 and a downstream station 16. While the air management system 12 has been illustrated in conjunction with the two-station production line 10, the air management system 12 is generally applicable to other production lines having a single station or a plurality of stations. In a single station production line, the nonwoven web can be manufactured using any one of a number of process, such as a meltblowing process or a spunbond process.

In a multiple-station production line, a plurality of nonwoven webs can be manufactured to form a multiply laminate. Any combination of meltblowing and spunbonding processes may be used to manufacture the laminate. For instance, the laminate may include only nonwoven meltblown webs or only nonwoven spunbond webs. However, the laminate may include any combination of meltblown webs and spunbond webs.

The two-station production line 10 in FIG. 1 is shown forming a two-ply laminate 18 with a meltblown layer or web 20 on the bottom and a spunbond layer or web 22 on the top. The two-ply laminate 18 is consolidated downstream using compacting rolls, for example. The upstream station 14 includes a melt spinning assembly 24 with a metblowing die 26 and the downstream station 16 includes a melt spinning assembly 28 with a spunbond die 30.

To form the meltblown web 20, the meltblowing die 26 extrudes a plurality of thermoplastic filaments or fibers 32 onto a collector such as a belt 34. It will be appreciated that the collector 34 may be any other substrate, such as a substrate used as a component in the manufacture of a product. Converging sheets or jets of hot air, indicated by arrows 36, from the meltblowing die 26 impinge upon the fibers 32 as they are extruded to stretch or draw the fibers 32. The fibers 32 are then deposited in a random manner onto the collector moving belt 34 from right to left to form the meltblown web 20. The collector belt 34 is perforated to permit the air to flow through the collector belt 34 and into the air management system 12.

Similarly, to form the spunbond web 22, the spunbond die 30 extrudes a plurality of thermoplastic filaments or fibers 38 onto the meltblown web 20 being transported by the moving collector belt 34. Hot air, indicated by arrows 40, from the spunbond die 30 impinges upon the fibers 38 to impart rotation to the fibers 38. Additionally, air ducts 42 direct quenching air onto the extruded fibers 38 to cool the fibers 38 before they reach the meltblown web 20. As with the upstream station 14, the air at downstream station 16 passes through the nonwoven web 20 and the collector belt 34 and into the air management system 12.

Several cubic feet of air per minute per inch of die length flow through each station 14, 16 during the manufacture of the meltblown and spunbond webs 20, 22. The air management system 12 of the invention efficiency collects and disposes of the air from through the stations 14, 16. More importantly and as will be discussed in greater detail below, the air management system 12 collects the air such that the air has a substantially uniform flow velocity at least in the cross-machine direction as the air passes through the collector belt 34. Ideally, the fibers 32, 38 are deposited on the collector belt 34 in a random fashion to form the meltblown and spunbond webs 20, 22 which are homogeneous. If the air flow velocity through the collector belt 34 is nonuniform, the resultant web will likely not be homogeneous.

Figure 2:
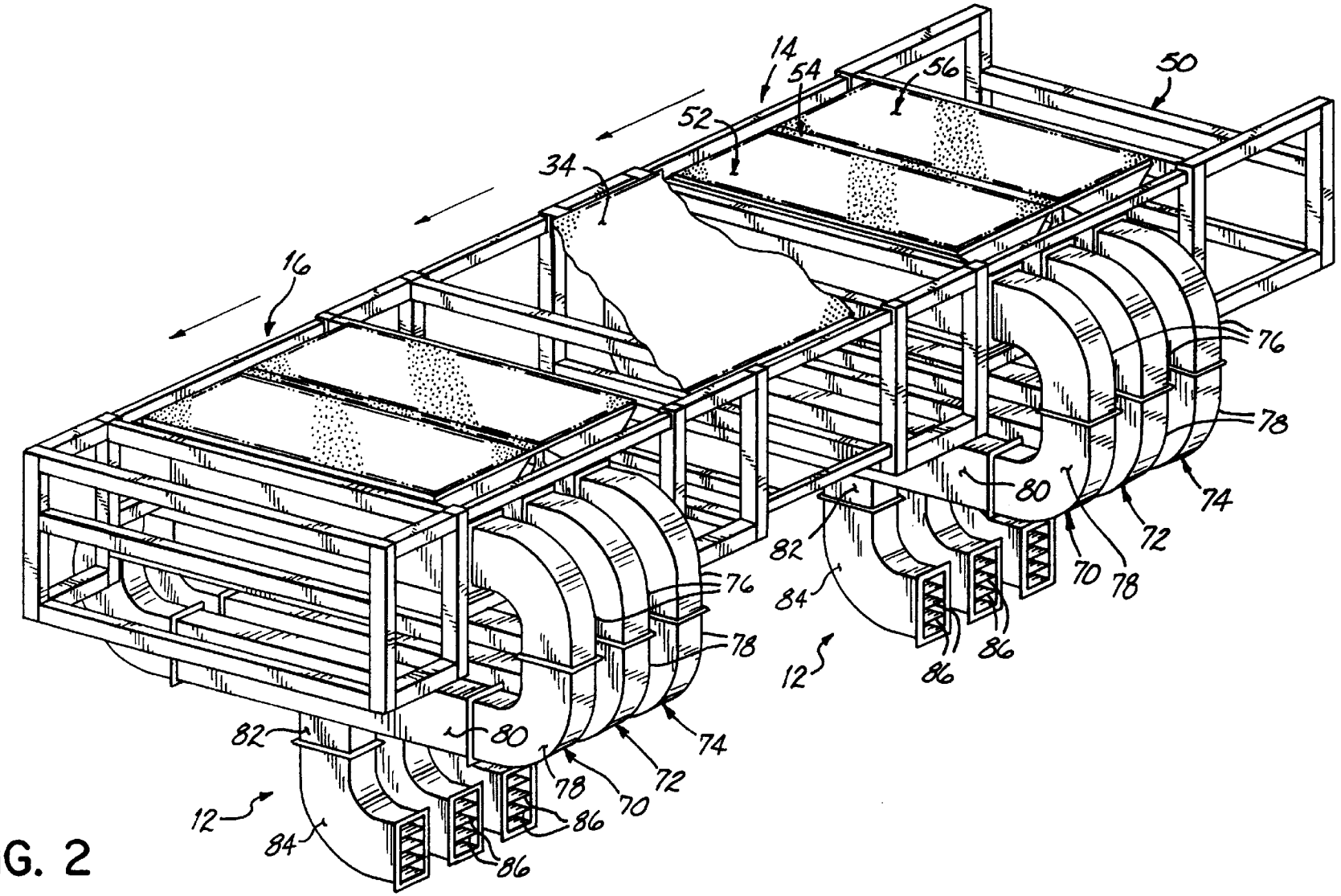
FIG. 2 is a perspective view of the two-station production line of FIG. 1 with the collector belt removed for clarity.

With reference to FIG. 2, transport structure 50 of the two-station production line 10 of FIG. 1 is shown. While the two-station production line 10 includes two air management systems 12, the following description will focus on the air management system 12 associated with the upstream station 14. Nevertheless, the description will be equally applicable to the air management system associated with downstream station 16.

Figure 3:
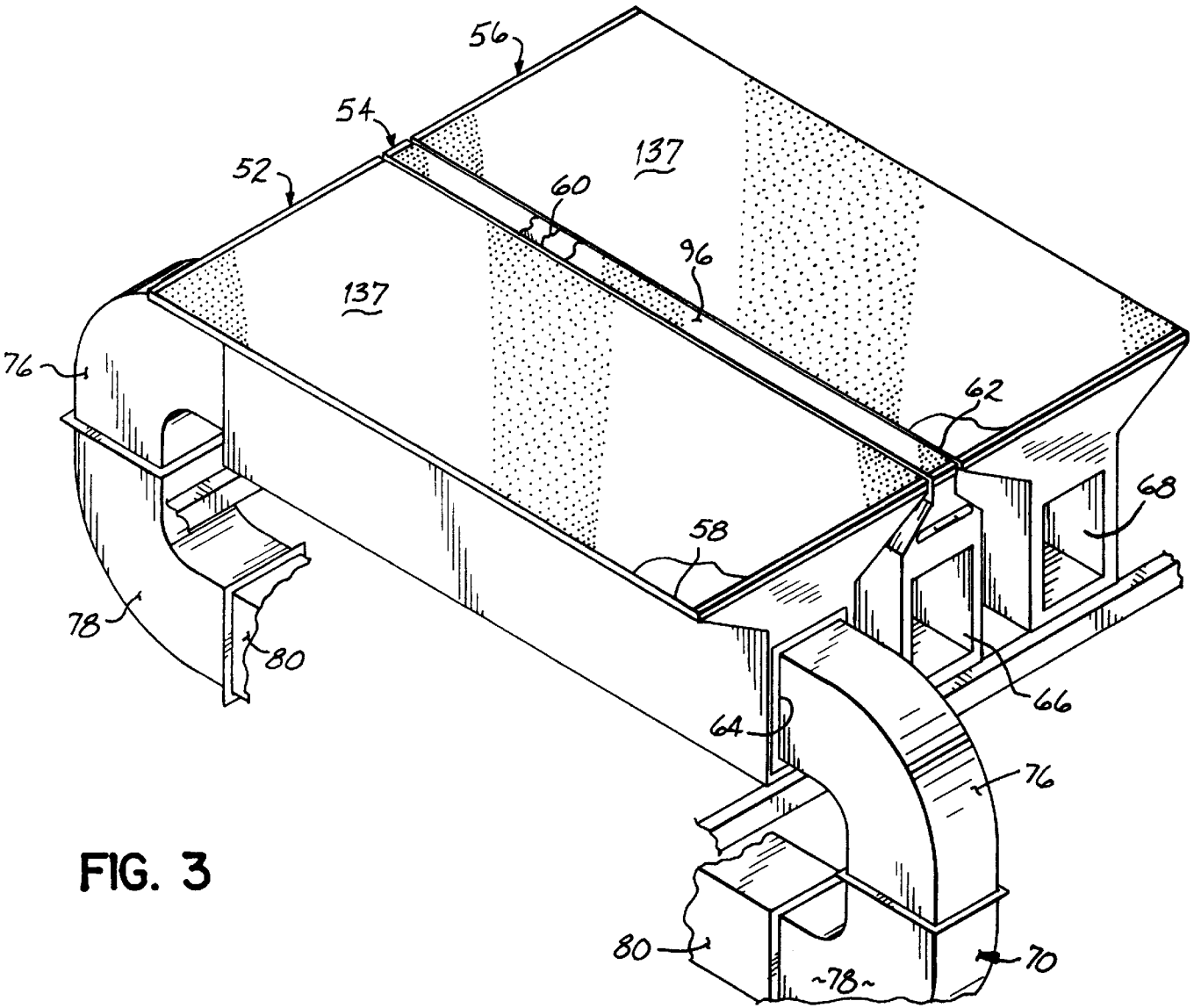
FIG. 3 is a perspective view of the air management system of FIG. 1.

With further reference to FIGS. 2 and 3, air management system 12 includes three discrete air handlers 52, 54, 56 disposed directly below the collector belt 34. Air handlers 52, 54, 56 include intake openings 58, 60, 62 and oppositely disposed exhaust openings 64, 66, 68. Individual exhaust conduits 70, 72, 74 are connected respectively to exhaust openings 64, 66, 68. Exhaust conduit 70, which is representative of exhaust conduits 72, 74, is comprised of a series of individual components: first elbows 76, second elbows 78, elongated portion 80, down portion 82, and third elbow 84. A series of parallel guide vanes 86 extend through down portion 82 and third elbow 84. In operation, a variable speed fan (not shown) or any other suitable air moving device is connected to third elbow 84 to draw the air through the air management system 12.

With continued reference to FIGS. 2 and 3, air handler 54 is located directly below the forming zone, i.e., the location where the fibers contact the collector belt 34. As such, air handler 54 collects and disposes of the largest portion of air used during the extrusion process. Upstream air handler 56 and downstream air handler 52 collect spill over air which air handle 54 does not collect.

Figure 4:
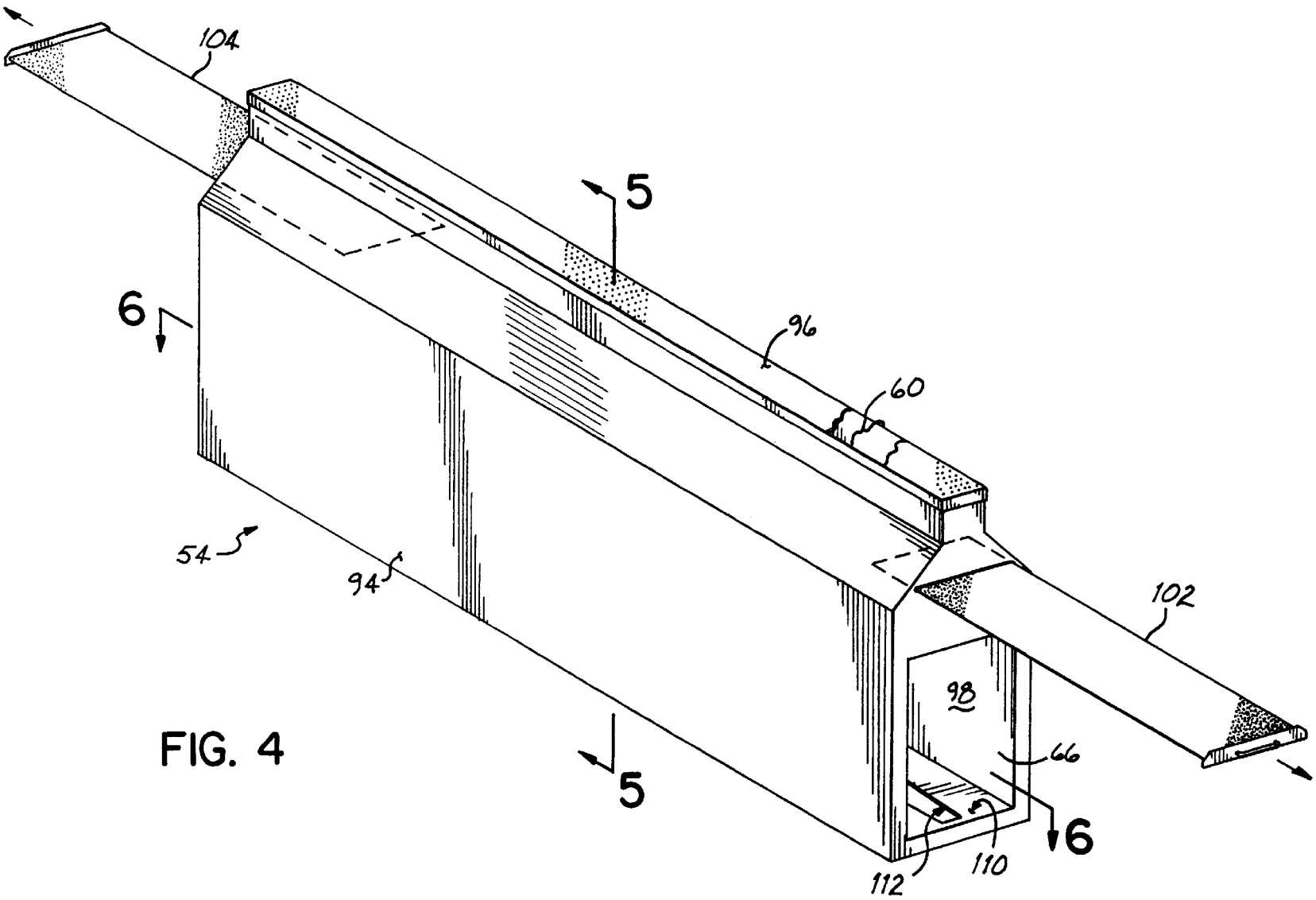
FIG. 4 is a partially disassembled perspective view of the forming zone air handler of FIG. 3.
Figure 5:
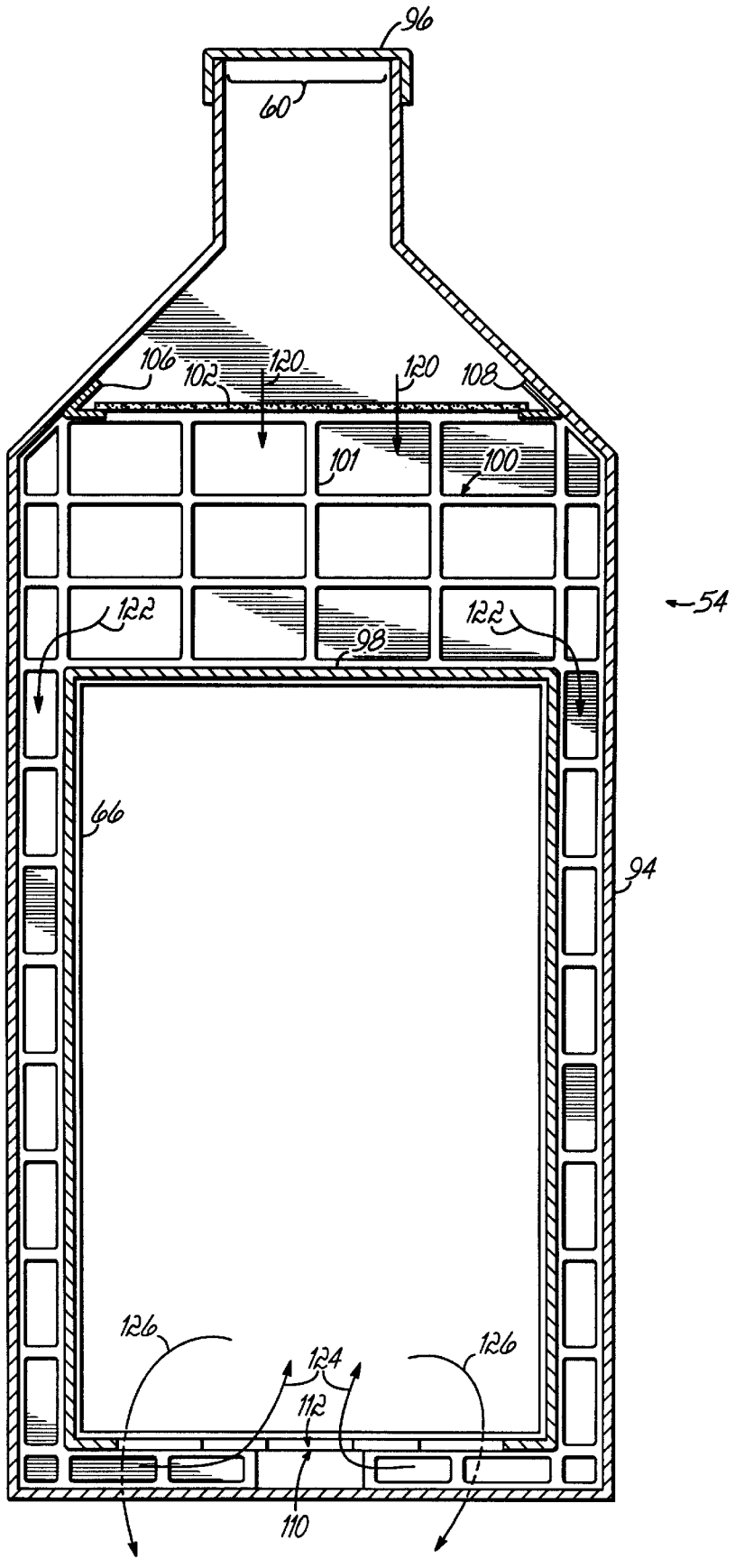
FIG. 5 is a cross sectional view of the forming zone air handler in FIG. 4 taken along lines 5—5.
Figure 6:
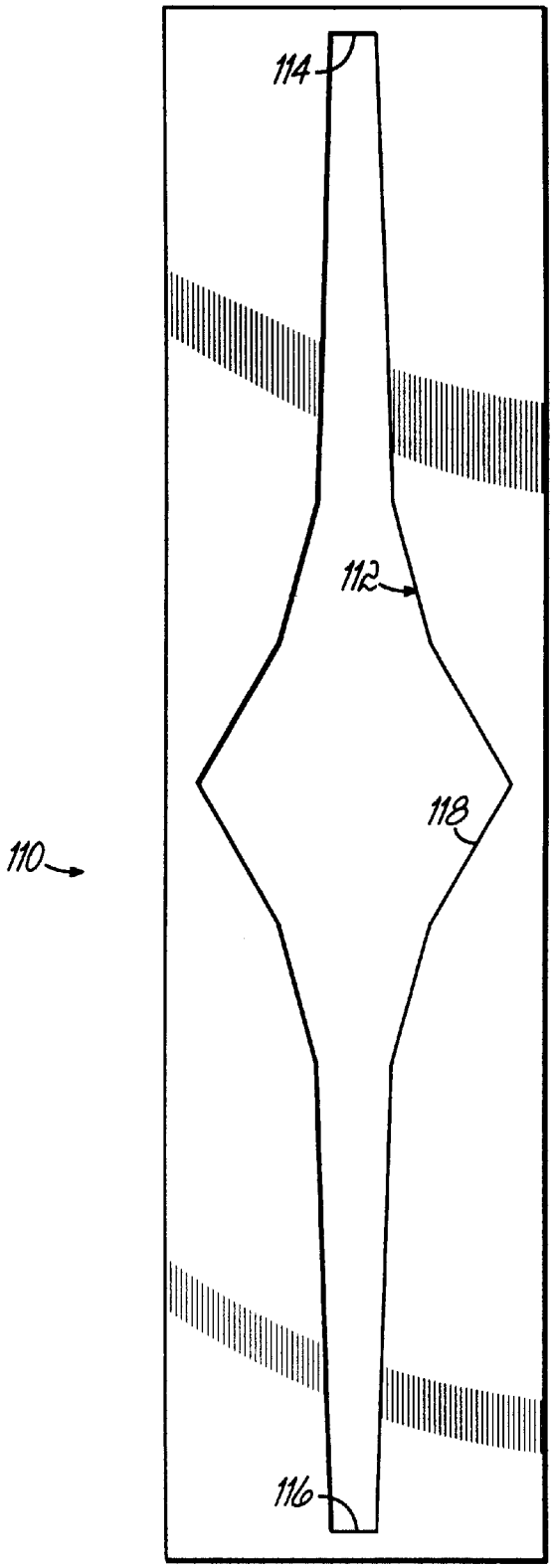
FIG. 6 is a plan view of the forming zone air handler bottom in FIG. 4 taken along lines 6—6.

With reference now to FIGS. 4–6, forming zone air handler 54 includes an outer housing 94 which includes intake opening 60 and oppositely disposed exhaust openings 66. Intake opening 60 includes a perforated cover 96 with a series of apertures through which the air flows. Depending of the manufacturing parameters, air handler 54 may be operated without using the perforated cover 96 at all. Air handler 54 further includes an inner housing or box 98 which is suspended from the outer housing 94 by means of spacing members 100 which include a plurality of openings 101 therein. Two filter members 102, 104 are selectively removable from air handler 54 so that they may be periodically cleaned. The filter members 102, 104 slide along stationary rail members 106, 108. Each of these filter members 102, 104 are perforated with a series of apertures through which the air flows.

The inner box 98 has a bottom panel 110 that includes an opening such as slot 112 with ends 114,116 and a center portion 118. As illustrated in FIG. 6, slot 112 extends substantially across the width, i.e., the cross-machine direction, of the inner box 98. The slot 112 is narrow at ends 114, 116 and widens at center portion 118. The slot 112 could be formed from one or more openings of various shapes, such as round, elongate, rectangular, etc.

The shape of slot 112 influences the air flow velocity in the cross machine direction at the intake opening 60. If the shape of the slot 112 is not properly contoured the air flow velocities at the intake opening 60 may vary greatly in the cross machine direction. The particular shape shown in FIG. 6 was determined through an iterative process using a computational fluid dynamics (CFD) model which incorporated the geometry of the air handler 54. A series of slot shapes were evaluated at intake air flow velocities ranging between 500 to 2500 feet per minute. After the CFD model analyzed a particular slot shape, the air flow velocity profile in the cross machine direction was checked. Ultimately, the goal was to choose a shape for the slot 112 which provided a substantially uniform air flow velocity in the cross machine direction at intake opening 60. Initially, a rectangular slot 112 was evaluated, yielding air flow velocities in the cross machine direction at the intake opening 60 which varied by as much as twenty percent. With the rectangular slot 112, the air flow velocities near the ends of the intake opening 60 were greater than the air flow velocities approaching the center of the intake opening 60. To address this uneven air flow velocity profile, the width of ends 114, 116 was reduced relative to the width of the center portion 118. After approximately five iterations, the shape of slot 118 is FIG. 6 was chosen. That slot shape yields air flow velocities in the cross machine direction at the intake opening 60 which varied by ±5.0%.

With specific reference to FIG. 5, air enters through perforated cover 96 and passes through perforated filter members 102, 104 as illustrated by arrows 120. The air passes through the gap between the inner box 98 and the outer housing 94 as illustrated by arrows 122. The air then enters the interior of inner box 98 through slot 112 as illustrated by arrows 124. Finally, the air exits the inner box 98 through exhaust opening 66 as illustrated by arrows 126 and then travels through exhaust conduit 72. The openings 101 in spacing members 100 allow the air to move in the cross-machine direction to minimize transverse pressure gradients.

Figure 7:
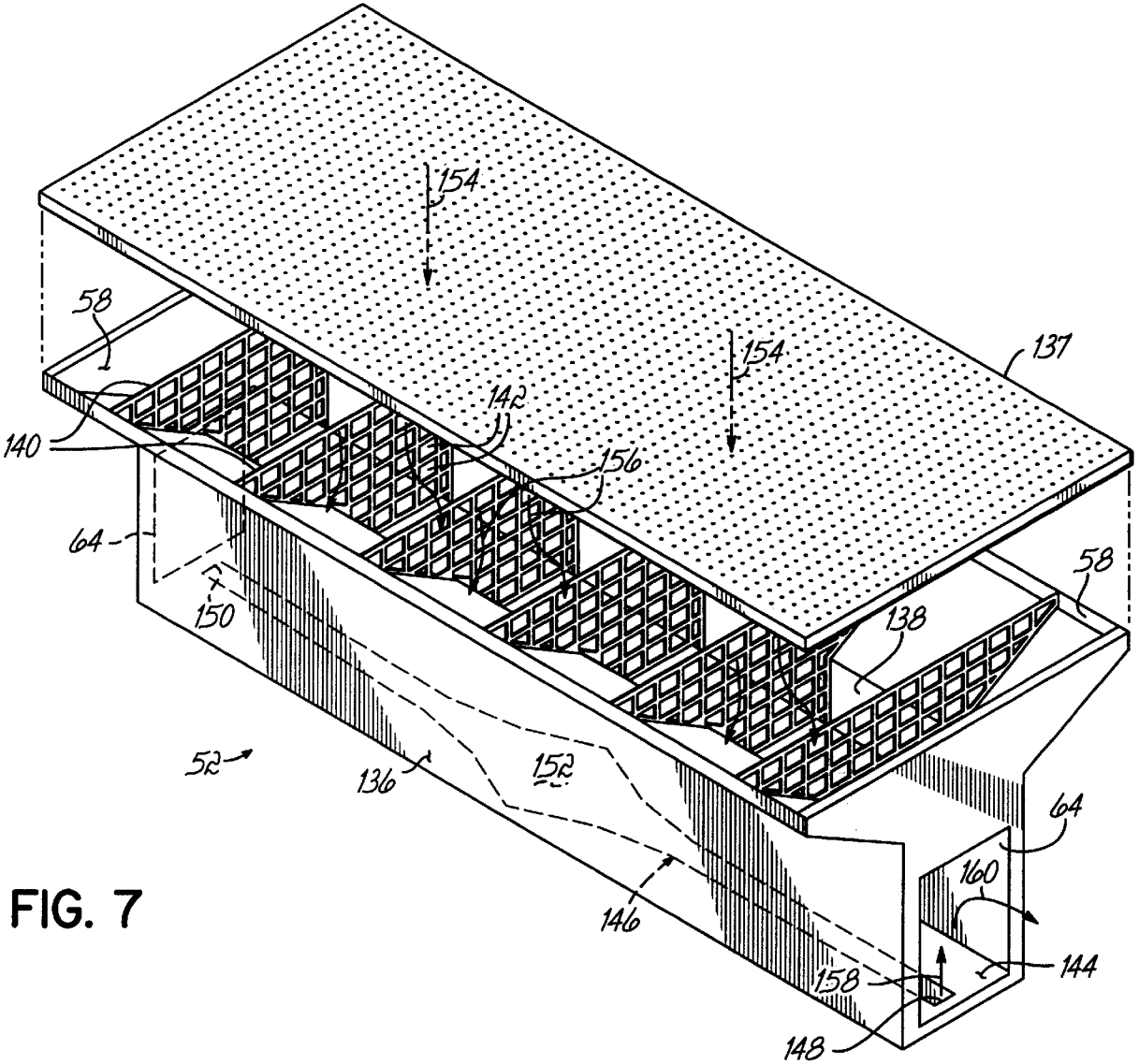
FIG. 7 is a partially disassembled perspective view of one of the spillover air handlers of FIG. 3.

Generally, air handlers 52, 56 have a similar construction and air flow path as air handler 54. However, as FIG. 3 illustrates, air handlers 52, 56 have much wider, i.e, in the machine direction, intake openings 58, 62 than intake opening 60 of air handler 54. The width of the these intake openings 58, 62 may vary depending on the particular manufacturing parameters. The following discussion of air handler 52 is equally applicable to air handler 56. Thus, with specific reference to FIG. 7, air handler 52 includes an outer housing 136 which includes intake opening 58 and exhaust openings 64. Intake opening 58 includes a perforated cover 137 with a series of apertures through which the air flows. Depending on the manufacturing parameters, air handler 52 may be operated without using perforated cover 137 at all. Air handler 52 further includes an inner housing or box 138 which is suspended from the outer housing 136 by means of spacing members 140 which include a plurality of openings 142 therein. Unlike air handler 54, air handlers 52, 56 do not include filter members 102, 104.

The inner box 138 includes a bottom panel 144 with a slot 146 which is configured similarly to slot 112. Slot 146 includes ends 148, 150 and center portion 152. Like slot 112, the width at center portion 152 is greater than the width at ends 148, 150.

As mentioned above, the air flow path through air handler 52 is similar to the air flow path in air handler 54. Specifically, air enters through perforated cover 137 as illustrated by arrows 154 and passes through the gap between the inner box 138 and the outer housing 136 as illustrated by arrows 156. The air then enters the interior of inner box 138 through slot 146 as illustrated by arrow 158. Finally, the air exits the inner box 138 through exhaust opening 64 as illustrated by arrow 160 and then travels through exhaust conduit 70. The openings 142 in spacing members 140 allow the air to move in the cross-machine direction to minimize transverse pressure gradients.

Figure 8:
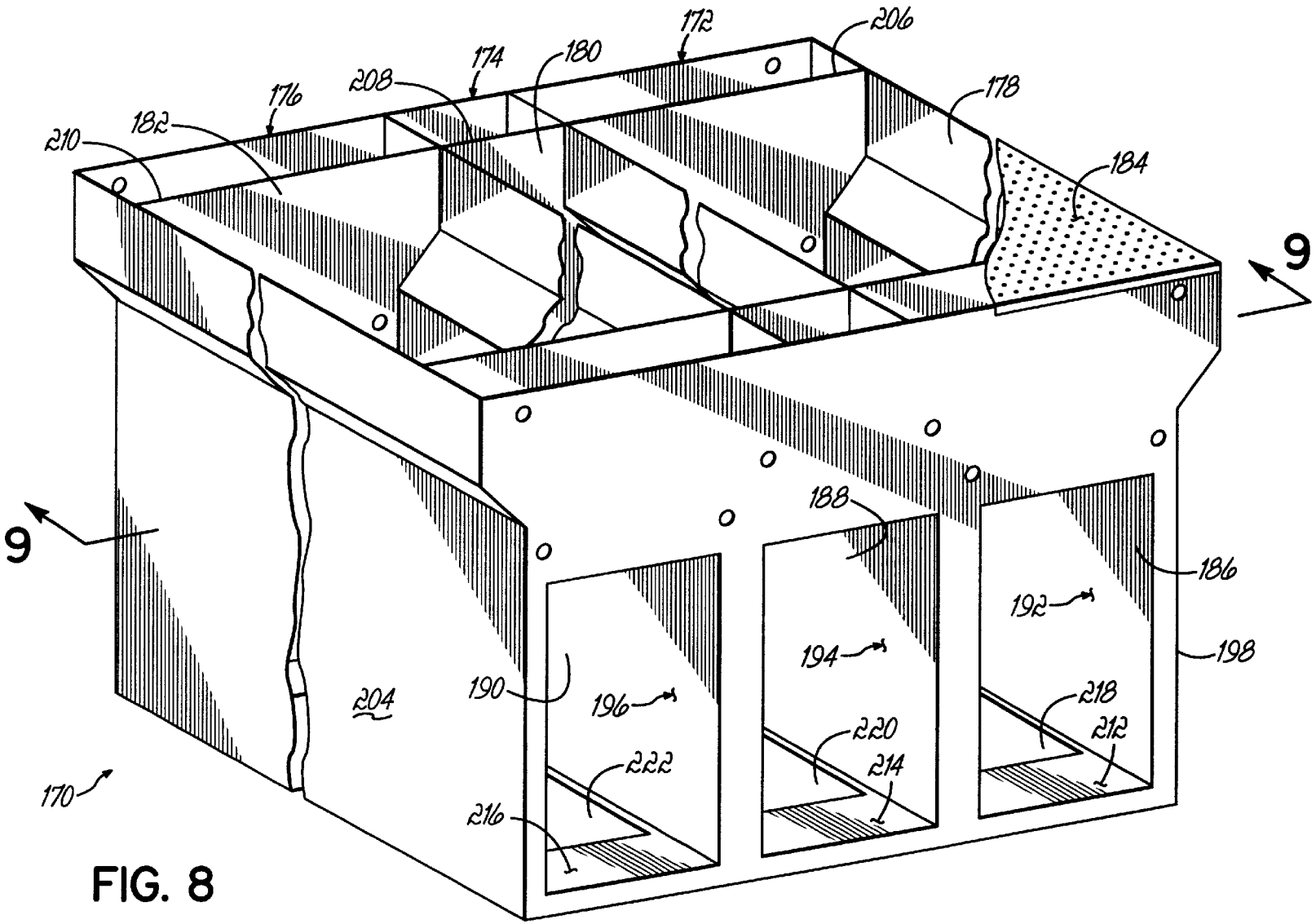
FIG. 8 is a perspective view of another embodiment of the air management system of the invention.
Figure 9:
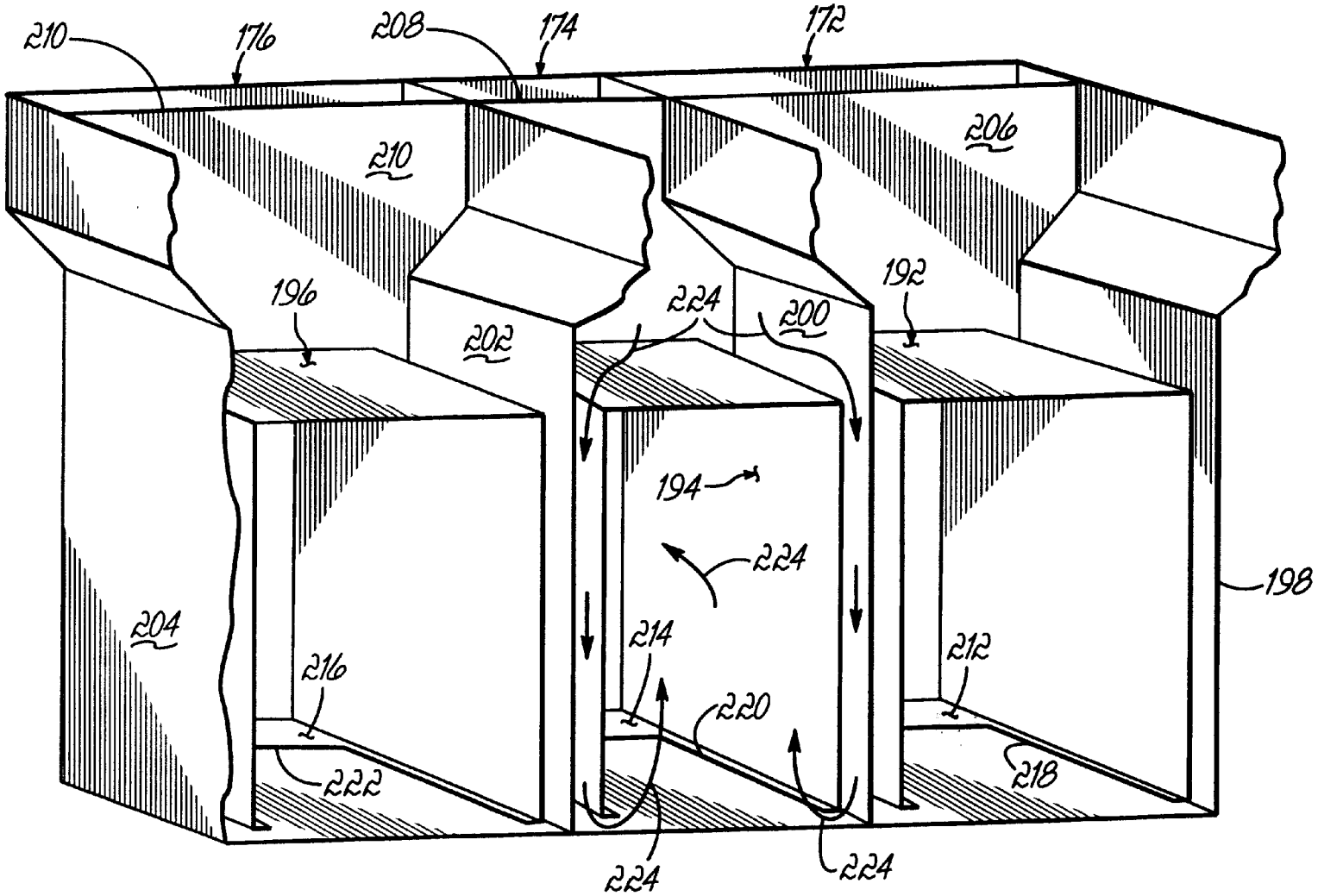
FIG. 9 is cross sectional perspective view of the air management system in FIG. 8 taken along lines 9—9.

Another embodiment of the air management system of the invention is shown generally as 170 in FIGS. 8 and 9. As described above, air management system 12 includes three separate and discrete air handlers 52, 54, 56. In contrast, air management system 170 includes air handlers 172, 174, 176 which share common walls to form a unitary device. Air handler 174 is placed under the forming zone of the production line to collect the majority of the process air and air handlers 172, 176 collect spill over air which air handler 174 does not collect. Each air handler 172, 174, 176 includes an intake opening 178, 180, 182 over which a single perforated cover 184 is placed. A plurality of individual perforated covers may be used in place of the single perforated cover 184. Each air handler 172, 174, 176 further includes exhaust openings 186, 188, 190 oppositely disposed on either end of the respective air handlers 172, 174, 176. Separate exhaust conduits (not shown) similar to exhaust conduits 70, 72, 74 connect to exhaust openings 186, 188, 190 to pull the air out of the air handlers 172, 174, 176. Air handler 174 may include a filter member having a perforated surface through which the incoming air flows.

Air handlers 172, 174, 176 include inner boxes 192, 194, 196 and sidewalks 198, 200, 202, 204. Spacing members 206, 208, 210 hold inner boxes 192, 194, 196 away from sidewalks 198, 200, 202, 204. Inner boxes 192, 194, 196 include bottom panels 212, 214, 216 having slots 218, 220, 222. The airflow path through air handlers 172, 174, 176 is similar to the air flow path in air handlers 52, 54, 56. The air flow path through air handler 174 is represented by arrows 224.

While the present invention has been illustrated by a description of various preferred embodiments and while these embodiments have been described in considerable detail in order to describe the best mode of practicing the invention, it is not the intention of applicants to restrict or in any way limit the scope of the appended claims to such detail. Additional advantages and modifications within the spirit and scope of the invention will readily appear to those skilled in the art. The invention itself should only be defined by the appended claims, wherein we claim:

What is claimed is:

1. An air handler for positioning below a melt spinning apparatus configured to discharge filaments of material onto a collector moving in a machine direction and collecting air discharged from the melt spinning apparatus, said air handler comprising:

an outer housing having walls defining a first interior space, one of said walls having an intake opening for receiving the discharged air and an exhaust opening for discharging the air, said intake opening in fluid communication with said first interior space; and an inner housing positioned within said first interior space and having walls defining a second interior space, at least one of said walls of said inner housing having an elongate intake having a length extending in a cross-machine direction, said first interior space communicating with said second interior space through said elongate intake, said second interior space in fluid communication with said exhaust opening.

2. The air handler of claim 1, wherein said elongate intake is a slot.

3. The air handler of claim 2, wherein said slot includes a center portion with a first width and oppositely disposed end portions each with a second width, said first width being greater than said second width.

4. The air handler of claim 1, wherein said outer housing includes a top and a bottom, one of said walls of said outer housing being a top wall and including said intake opening, one of said walls of said outer housing being a bottom wall and said elongate intake of said inner housing positioned proximate to said bottom wall of said outer housing.

5. The air handler of claim 1, wherein said outer housing further includes a filter member for filtering particulates from the air discharged from the melt spinning apparatus.

6. An air handler positioning below a melt spinning apparatus configured to discharge filaments of material onto a collector moving in a machine direction and collecting air discharged from the melt spinning apparatus, said air handler comprising:

an outer housing having walls defining a first interior space, one of said walls forming the top of said outer housing and including an intake opening for receiving the discharged air, one of said walls forming a side of said outer housing and including an exhaust opening, one of said walls forming the bottom of said outer housing, said intake opening being in fluid communication with said first interior space;

an inner housing positioned within said first interior space and having walls defining a second interior space, one of said walls of said inner housing forming the bottom of the inner housing and including an intake slot, said bottom wall being proximate to the bottom of the outer housing, said first interior space communicating with said second interior space through said intake slot, said second interior space in fluid communication with said exhaust opening.

7. The air handler of claim 6, wherein said intake slot is elongate and has a length extending in a cross-machine direction of the melt spinning apparatus.

8. The air handler of claim 7, wherein said elongate intake slot includes a center portion with a first width and oppositely disposed end portions each with a second width, said first width being greater than said second width.

9. The air handler of claim 6, wherein said outer housing further including a filter member for filtering particulates from the air discharged by the melt spinning apparatus.

10. An air handler for positioning below a melt spinning apparatus configured to discharge filaments of material onto a collector moving in a machine direction and collecting air discharged from the melt spinning apparatus, said air handler comprising:

an outer housing having first and second side walls, first and second end walls, a bottom wall and a top cover, said walls and said top cover defining a first interior space, said top cover having an intake opening for receiving the discharged air, said intake opening being in fluid communication with said first interior space;

an inner housing positioned within said first interior space and having first and second side walls and top and bottom walls, said walls defining a second interior space having a rectangular cross section, said walls having first and second ends abutting said first and second end walls of said outer housing and conforming to said exhaust openings therein, said bottom wall of said inner housing being proximate to the bottom of the outer housing and including an intake slot aligned along the longitudinal axis of the inner housing, said intake slot having a center portion with a first width and oppositely disposed end portions each with a second width, said first width being greater than said second width, said first interior space communicating with said second interior space through said intake slot, said second interior space in fluid communication with said exhaust openings.

11. The air handier of claim 10, wherein said outer housing further including a filter member for filtering particulates from the air discharged by the melt spinning apparatus.

12. An air management system for collecting air discharged from a melt spinning apparatus configured to discharge filaments of material onto a collector moving in a machine direction, the air management system includes first, second, and third air handlers, the second air handler positioned directly below the melt spinning apparatus in a forming zone, the first air handler being positioned upstream of the second air handler and the forming zone, the third air handler being positioned downstream of the second air handler and the forming zone, each air handler comprising:

an outer housing having walls defining a first interior space, one of said walls having an intake opening for receiving the air and an exhaust opening for discharging the air, said intake opening in fluid communication with said first interior space; and an inner housing positioned within said first interior space and having walls defining a second interior space, at least one of said walls of said inner housing having an elongate intake, said first interior space communicating with said second interior space through said elongate intake, said second interior space in fluid communication with said exhaust opening.

13. The air management system of claim 12, wherein said elongate intake is an elongate slot having a length extending in a cross-machine direction of the melt spinning apparatus.

14. The air management system of claim 13, wherein said elongate slot includes a center portion with a first width and oppositely disposed end portions each with a second width, said first width being greater than said second width.

15. The air management system of claim 12, wherein each outer housing includes a top and a bottom, one of said walls of each outer housing being a top wall and including said intake opening, one of said walls of each outer housing being a bottom wall and each elongate intake of each inner housing positioned proximate to said bottom wall of each outer housing.

16. The air management system of claim 12, wherein each outer housing further includes a filter member for filtering particulates from the air discharged by the melt spinning apparatus.

17. The air management system of claim 12, wherein said intake opening of said first and third air handlers has a width in said machine direction, said intake opening of said second air handler has a width in said machine direction, said width of said intake opening of said first and third air handlers being greater than the width of said intake opening of said second air handler.

18. The air management system of claim 12, wherein each air handler is separate and distinct from the other air handlers.

19. A system for manufacturing nonwoven webs comprising:

a melt spinning apparatus adapted to discharge filaments of material, said melt spinning apparatus including at least one discharge orifice, said discharge orifice adapted to discharge a stream of pressurized air onto the filaments;

a collector belt positioned below said melt spinning apparatus for receiving the filaments and moving in a machine direction; and an air handler positioned below said collector belt and including an outer housing having walls defining a first interior space, one of said walls having an intake opening for receiving the discharge air and an exhaust opening for discharging the air, said intake opening in fluid communication with said first interior space; and an inner housing positioned within said first interior space and having walls defining a second interior space, at least one of said walls of said inner housing having an elongate intake, said first interior space communicating with said second interior space through said elongate intake, said second interior space in fluid communication with said exhaust opening.

20. The system of claim 19, wherein said elongate intake is an elongate slot having a length extending in a cross-machine direction of the melt spinning apparatus.

21. The system of claim 20, wherein said elongate slot includes a center portion with a first width and oppositely disposed end portions each with a second width, said first width being greater than said second width.

22. The system of claim 19, wherein said outer housing includes a top and a bottom, one of said walls of said outer housing being a top wall and including said intake opening, one of said walls of said outer housing being a bottom wall and said elongate intake opening of said inner housing positioned proximate to said bottom wall of said outer housing.

23. The system of claim 19, wherein said outer housing further including a filter member for filtering particulates from the air discharged from the melt spinning apparatus.

* * * * *